US009390691B2

(12) United States Patent
Curran

(10) Patent No.: US 9,390,691 B2
(45) Date of Patent: Jul. 12, 2016

(54) DEVICE AND METHOD FOR REPLACEMENT OF MUSICAL INSTRUMENT STRINGS

(71) Applicant: Theodore Buxhoeveden Curran, Hollis, NH (US)

(72) Inventor: Theodore Buxhoeveden Curran, Hollis, NH (US)

( * ) Notice: Subject to any disclaimer, the term of this patent is extended or adjusted under 35 U.S.C. 154(b) by 0 days.

(21) Appl. No.: 14/644,671

(22) Filed: Mar. 11, 2015

(65) Prior Publication Data

US 2015/0262560 A1 Sep. 17, 2015

Related U.S. Application Data

(60) Provisional application No. 61/952,083, filed on Mar. 12, 2014.

(51) Int. Cl.
*G10D 9/00* (2006.01)
*G10D 3/00* (2006.01)

(52) U.S. Cl.
CPC ..... *G10D 3/006* (2013.01)

(58) Field of Classification Search
CPC ..... G10D 3/006
USPC ..... 84/453
See application file for complete search history.

(56) References Cited

U.S. PATENT DOCUMENTS

| | | | | |
|---|---|---|---|---|
| 4,377,963 | A * | 3/1983 | Siminoff | G10D 3/14 84/197 |
| 4,388,743 | A * | 6/1983 | Hellinger | A47J 45/10 16/435 |
| 5,272,953 | A | 12/1993 | Koch | |
| 5,505,116 | A | 4/1996 | Pantoja | |
| 6,255,575 | B1 | 7/2001 | Pearse | |
| 6,294,719 | B1 | 9/2001 | Palecki | |
| 6,489,548 | B1 | 12/2002 | Schindler | |
| 6,580,022 | B2 | 6/2003 | Kang | |
| 7,534,946 | B1 | 5/2009 | Oxenhandler | |
| 8,278,539 | B1 | 10/2012 | Botz | |
| 8,354,578 | B2 | 1/2013 | Decker | |
| 2005/0284280 | A1 * | 12/2005 | Izen | G10G 7/00 84/290 |
| 2013/0008297 | A1 | 1/2013 | Adams | |

* cited by examiner

*Primary Examiner* — Jianchun Qin
(74) *Attorney, Agent, or Firm* — Jonathan B. Whitcomb; Sheehan Phinney Bass & Green PA

(57) ABSTRACT

A device for assisting winding a string around a tuning post of a tuning machine of a stringed instrument, is disclosed. An enclosure has an exterior surface, a base, a cap, and a central bore passing through a base aperture. A string ingress aperture passes between the enclosure exterior surface and the central bore. A slot passes through the enclosure exterior surface extending from the ingress aperture to the base, and string egress aperture passes through the enclosure between the enclosure surface and the central bore. The enclosure is configured to substantially enclose the tuning post within the central bore.

16 Claims, 10 Drawing Sheets

DEVICE AND METHOD FOR REPLACEMENT OF MUSICAL INSTRUMENT STRINGS

CROSS-REFERENCE TO RELATED APPLICATIONS

This application claims the benefit of U.S. Provisional Patent Application Ser. No. 61/952,083, filed Mar. 12, 2014, entitled "Enclosure Device to Assist in the Replacement of Musical Instrument Strings," which is incorporated by reference herein in its entirety.

FIELD OF THE INVENTION

The present invention relates to musical instruments, and more particularly, is related to stringing of stringed musical instruments.

BACKGROUND OF THE INVENTION

It is desirable to replace strings on musical instruments often, either to maintain sound quality as strings wear, or to replace broken strings. Replacing the strings of a musical instrument, such as a guitar, may be a difficult and tedious task to accomplish. Many users, for example, novice and/or young users, choose to consult a professional to change strings, resulting in lost time, enjoyment, and unnecessary costs.

There are several devices that have been designed to aid an individual in the replacement of strings; however, there are some shortcomings to these devices. Some require expensive after-market installation of parts, such as locking tuners, for example, as disclosed in U.S. Pat. No. 6,580,022. Others are more affordable, but do not solve the problem entirely, such as string winders, for example, as disclosed in U.S. Pat. No. 5,272,953.

FIG. 1 shows a partial view of the upper neck 50 and headstock 52 of a prior art guitar. Six conventional tuning machines 40 are located on the headstock 52, each having a post 47 or peg, and a tuning button 46 or handle. Each tuning machine 40 is generally attached to the back surface of the guitar headstock 52, with the post 47 extending through an aperture in the headstock 52, and a winding shaft 44 extending outward from the back of the headstock 52. The winding shaft rotates around an axis 71. The post 47 is connected to the winding shaft 44 via a gear mechanism, which may be open or enclosed. The post 47 is generally secured to the top surface of the headstock 52 via a bearing 45. To replace a string 13, the user threads the string through a borehole 48 of the tuning post 47. The user then repeatedly turns the winding shaft 44 via the tuning button 46, causing the tuning post 47 to rotate. The string 13 is wound around the tuning post 47 as the tuning post 47 rotates. However, there are several factors that make this task difficult.

For one, the user must hold the string 13 as it winds around the tuning post 47 to prevent the string 13 from slipping off the tuning post 47. Strings 13 are commonly made of metal alloys and may be awkward to handle and cause discomfort and pain as tension is applied, particularly for novice and/or young users. Concurrently, to wind a string, the user must apply considerable force by turning the tuning button 46. Due to the natural resistance of the string 13 to bending, the string 13 may not immediately wind flush around the tuning post 47. Instead, the string 13 may begin to wind in large loops, which become successively smaller as the string 13 winds down.

There is a point where the user must hold down the string 13 against its preferred position to prevent the loops of string 13 from sliding off the tuning post 47. This may be difficult due to the high tension on the string 13, and because the user has only one hand available, as the other hand is turning the tuning button 46. If the string 13 slides off the tuning post 47, the user will have to restart the process. In some cases, the bent string 13 may be crimped and is not salvageable, resulting in losses of time and money for the user. Therefore, there is a need in the industry to address one or more of the above-mentioned shortcomings.

SUMMARY OF THE INVENTION

Embodiments of the present invention provide a device and method for replacement of musical instrument strings. Briefly described, the present invention is directed to a device for assisting winding a string around a tuning post of a tuning machine of a stringed instrument. A device enclosure has an exterior surface, a base, a cap, and a central bore passing through a base aperture. A string ingress aperture passes between the enclosure exterior surface and the central bore. A slot passes through the enclosure exterior surface extending from the ingress aperture to the base, and string egress aperture passes through the enclosure between the enclosure surface and the central bore. The enclosure is configured to substantially enclose the tuning post within the central bore.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principals of the invention.

DETAILED DESCRIPTION

Figure 1:
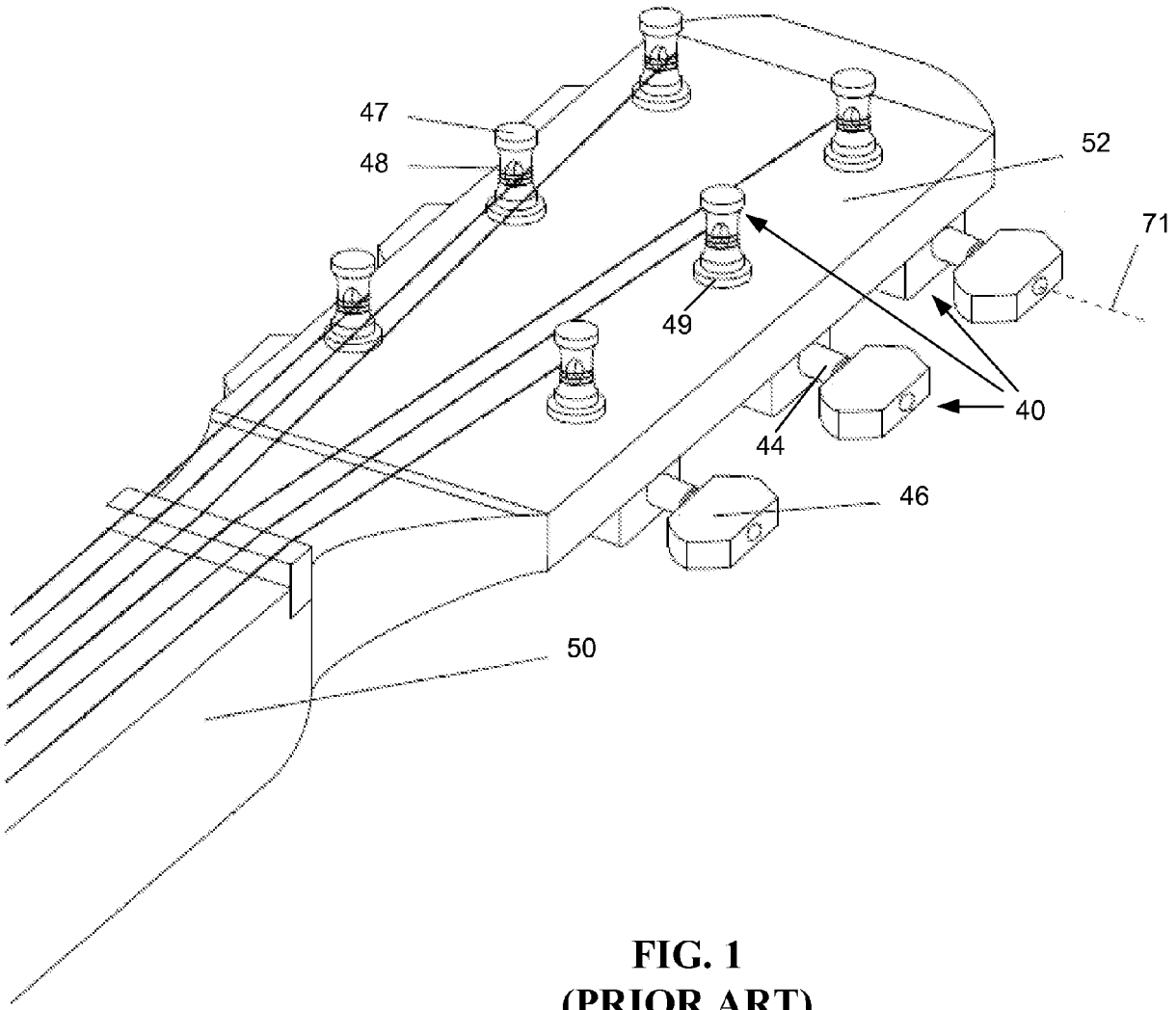
FIG. 1 (PRIOR ART)
FIG. 1 is a schematic diagram showing an upper neck and headstock of a prior art guitar.

The following definitions are useful for interpreting terms applied to features of the embodiments disclosed herein, and are meant only to define elements within the disclosure. No limitations on terms used within the claims are intended, or should be derived, thereby. Terms used within the appended claims should only be limited by their customary meaning within the applicable arts.

As used within this disclosure, the "string end" is the portion of an instrument string that is threaded through the tuning post. The "forward portion" of the string refers to a portion of the instrument string that does not pass through the tuning post, but rather extends toward the neck and body of the instrument.

Reference will now be made in detail to embodiments of the present invention, examples of which are illustrated in the accompanying drawings. Wherever possible, the same reference numbers are used in the drawings and the description to refer to the same or like parts.

Embodiments of the present invention include a device and method for facilitating and expediting the replacement of instrument strings by providing an enclosure around the string and tuning post during string winding. FIG. 2A is schematic diagram showing a front perspective view of a first embodiment of an enclosure device 200. Under the first embodiment, the device 200 does not attach to a tuning post 47 (FIG. 1) of an instrument. The device 200 includes of a main body 202 and a grip 201.

Figure 2A:
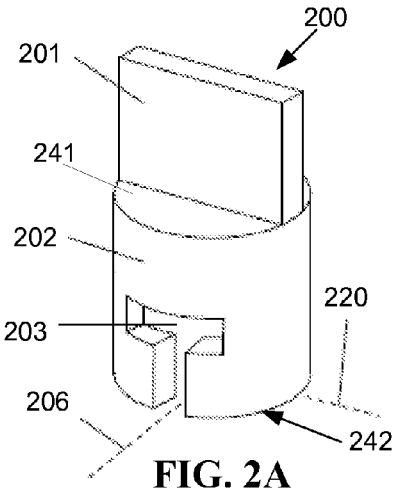
FIG. 2A is a schematic diagram showing a front perspective view of a first embodiment of an enclosure device.
Figure 2B:
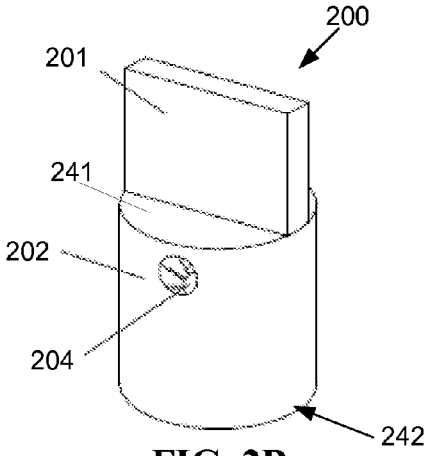
FIG. 2B is a schematic diagram showing a rear perspective view of the first embodiment of the enclosure device.
Figure 2C:
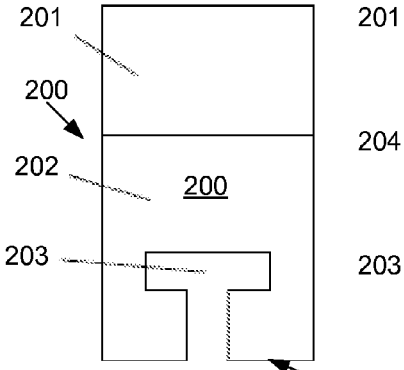
FIG. 2C is a schematic diagram showing a front view of the first embodiment of the enclosure device.
Figure 2D:
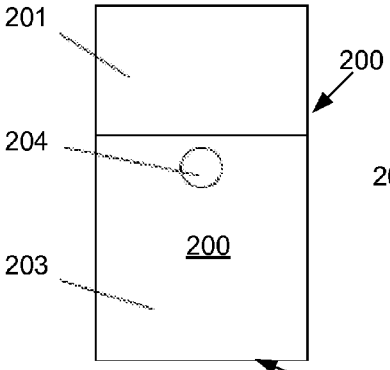
FIG. 2D is a schematic diagram showing a rear view of the first embodiment of the enclosure.
Figure 2E:
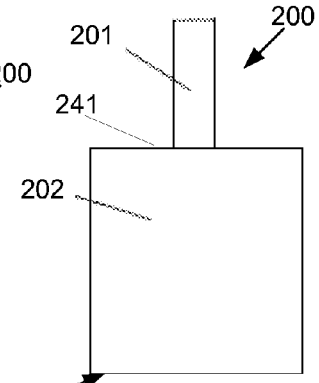
FIG. 2E is a schematic diagram showing a side view of the first embodiment of the enclosure device.

FIG. 2C is a schematic diagram showing a front view of the first embodiment of the enclosure device. FIG. 2D is a schematic diagram showing a rear view of the first embodiment of the enclosure. FIG. 2E is a schematic diagram showing a side view of the first embodiment of the enclosure device.

Under the first embodiment, the grip 201 includes a substantially flat rectangular profile tab extending from the cap 241 of the body 202, such that the grip 201 may be held between the fingers of a user to secure the device in place during use. One or more surfaces of the grip 201 may be smooth, or may be textured to prevent slipping. While FIGS. 2A-2F depict the grip 201 as being substantially rectangular, in alternative embodiment the grip 201 may take other forms. For example, the grip 201 may be implemented as a textured exterior surface or surface portion of the body 202. Similarly, the surfaces of the grip may be indented or padded to facilitate finger gripping. Other implementations are also possible. The grip 201 may be shaped to facilitate holding by hand tools, such as pliers or a wrench. For example, the grip 201 may be implemented as a hex shaped extension from the body 202 to facilitate being held by a wrench.

Figure 2F:
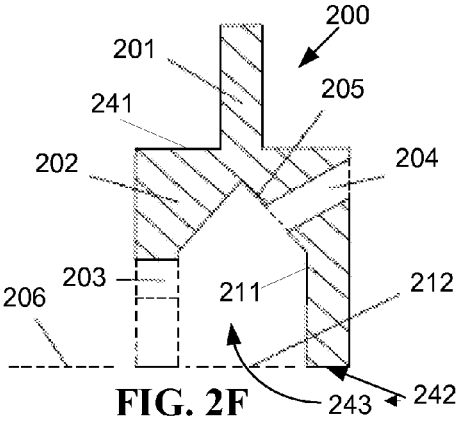
FIG. 2F is a schematic diagram showing a cross-sectional view of the first embodiment of the enclosure device.
Figure 3:
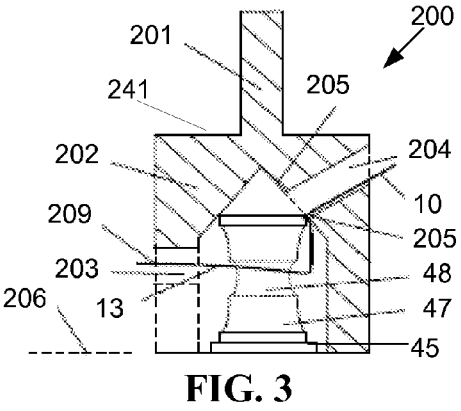
FIG. 3 is a schematic diagram showing a cross-sectional view of the first embodiment of the enclosure device enclosing a tuning post.

Under the first embodiment, the main body 202 is substantially cylindrical in shape, having a cap 241 and a base 242. As shown in FIG. 2F, the main body 202 is substantially hollow, having a central bore 243 formed through the base 242. The central bore 243 is sized to accommodate the tuning post 47 when the enclosure device 200 is place over the tuning post 47 (FIG. 3). For example, the central bore 243 may have a substantially circular cross sectional shape, as viewed from the base 242, corresponding to the cylindrical shape of the tuning post 47 (FIG. 3). The main body 202 is preferably formed of a substantially rigid material, for example, plastic, hard rubber, metal, wood, or other materials.

A front opening 203 and a rear exit 204, shown in FIG. 2B, are configured to facilitate a guitar string 13 (FIG. 1). The front opening 203 and rear exit 204 may be disposed on substantially opposite sides of the main body 202, generally corresponding to the borehole 48 (FIG. 3) of the tuning post 47 (FIG. 3). The front opening 203 and rear exit 204 each extend from an outer surface of the main body 202 through to the central bore 243 (FIG. 2F). The front opening 203 extends vertically through and upward from the base 242, forming a slot through the body 202. Under the first embodiment, the front opening 203 extends laterally from either side of the slot to form a "T" shape to allow the string 13 (FIG. 3) to move into a preferred position as the string 13 (FIG. 3) is threaded through the borehole 4 (FIG. 3) wound around the post 47

(FIG. 3). For example, the crossbar portion of the T may be sized to allow for some clearance for the main body 202 to rotate somewhat around the post 47 without deflecting the string 13. Similarly, the crossbar portion of the T may be sized provide room to maneuver the string somewhat within the central bore 243 inside the main body 202.

The front opening 203 meets the base 242 of the main body 202 such that the string 13 (FIG. 3) may exit the front opening 203 when the enclosure 200 is removed after string winding is complete. FIG. 2F is a cross-sectional view of the enclosure device 200 from a perspective 220 (FIG. 2A) and cut along a plane 6 (FIG. 2A). The central bore 243 has a bore opening 212 and a closed ceiling 205. The ceiling 205 may be cone-shaped to accommodate the tuning posts 47 (FIG. 3) of various sizes. As described further below, the ceiling 205 may be configured such that a portion of the tuning post 47 (FIG. 3) contacts the ceiling 205 when the device 200 is placed over the tuning post 47, for example, when the base 242 is adjacent to the instrument headstock 52 (FIG. 1). Such an arrangement may facilitate pinching the string 13 (FIG. 3) between the tuning post 47 (FIG. 3) and the ceiling 205, for example, to hold the string 13 during winding.

FIG. 3 illustrates the device 200 placed over a tuning post 47. The string 13 travels through the front opening 203 of the device 200, through the borehole 48 of the tuning post 47, and through the rear exit 204 of the device 200. The rear exit 204 may preferably be placed higher than the front opening 203 relative to the base 242 in order to pinch the string 13 between the tuning post 47 and the ceiling 205 and/or inner wall 211 of the device 200. Pinching may assist positioning the string 13 for better winding and may prevent the tail end 10 of the string 13 from undesirable winding, thus facilitating the forward end 9 of the string 13 to wind around the tuning post 47. It should be noted that while the tail end 10 of the string 13 may experience some winding around the post 47, this is generally inconsequential as the string tail end 10 is typically cut off and discarded after winding. In alternate embodiments, for example but not limited to, where the grip 201 is not positioned on the cap 241 of the body 202, the exit opening 204 may be disposed through the cap 241 of the body 202.

Figure 21:
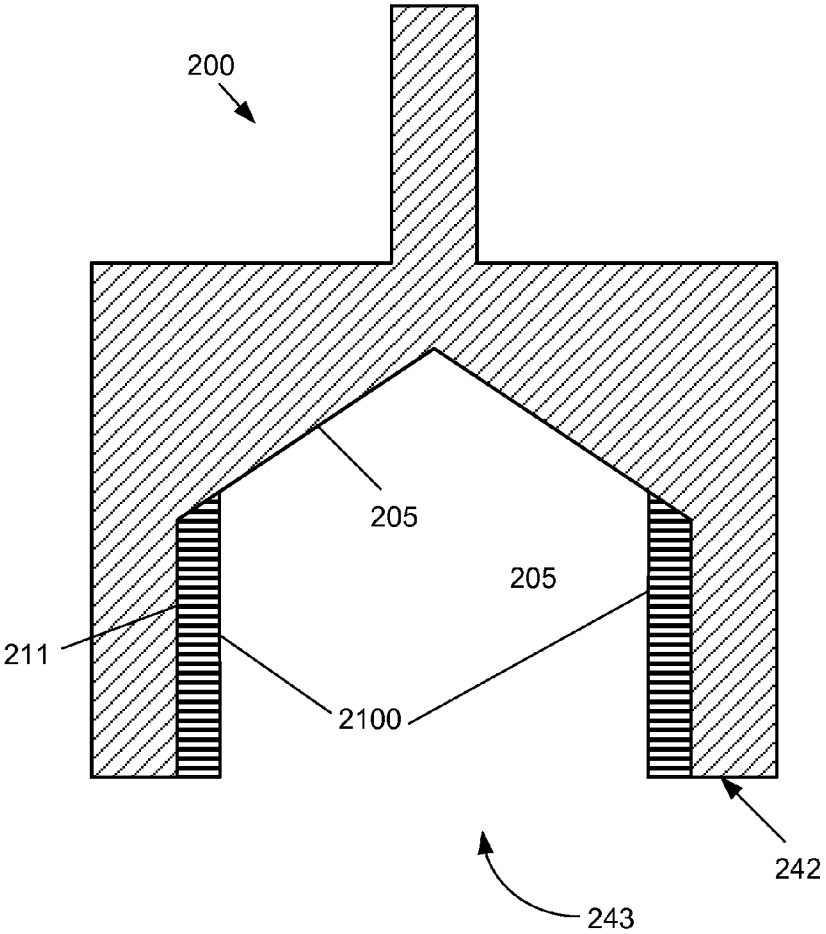
FIG. 21 is a schematic diagram of an exemplary embodiment of an insert for use with one or more embodiment of the enclosure device.

As shown in FIG. 21, the device 200 may optionally include a removable central bore insert 2100, for example, so that the central bore 243 may accommodate differently sized tuning posts 47. The central bore insert 2100 is configured to line at least a portion of the inner wall 211 of the central bore 243. In addition, the central bore insert 2100 may further be configured to cover a portion of or all of the ceiling 205. The central bore insert 2100 may be made of the same material as the main body 202, or may be formed of another material. For example, the central bore insert 2100 may be formed of a compressible material to assist pinching of the string tail end 10 (FIG. 4A) against the post 47 during winding. The central bore insert 2100 may generally be configured to have apertures (not shown) corresponding to the front opening 203 and rear exit 204 of the main body 202.

Figure 22:
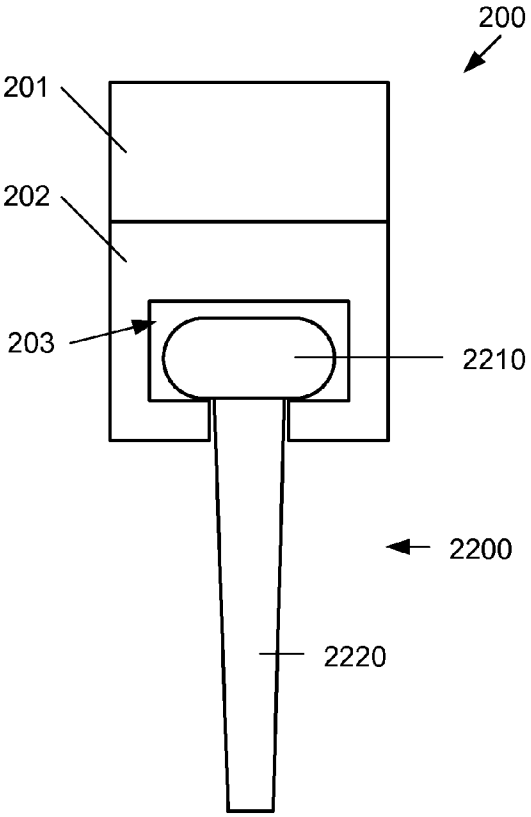
FIG. 22 is a schematic diagram of an exemplary of the first embodiment with a front opening configured to accommodate a bridge pin.

As shown in FIG. 22, the T shape of the front opening 203 may optionally be configured such that the device 200 serves as a bridge pin puller. For example, the T shaped crossbar portion may be configured such that a head 2210 of a bridge pin 2200 fits through the cross bar portion, and a stem 2220 of the bridge pin 2200 fits through the vertical slot of the front opening 203, so that the slot accommodates the stem 2220 beneath the bridge pin head 2210 so pulling on the grip 201 dislodges the bridge pin 2200 from a bridge pin hole.

Figure 20:
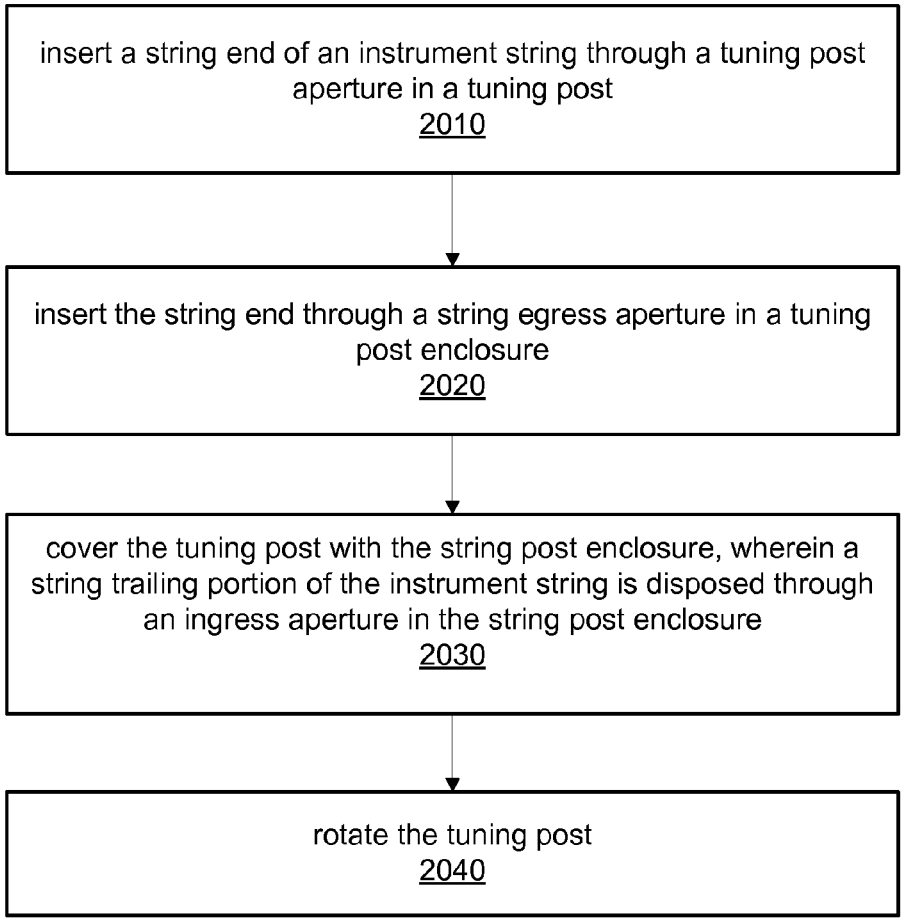
FIG. 20 is a flowchart of an exemplary method for stringing a musical instrument.
Figure 20:
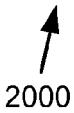

FIG. 20 is a flowchart of an exemplary method 2000 for stringing a stringed musical instrument. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by persons reasonably skilled in the art of the present invention. The method 2000 is illustrated with drawings of the device 200 shown in FIGS. 4A-4E, although it should be noted that the method 2000 is also applicable to other embodiments of the device.

Figure 4C:
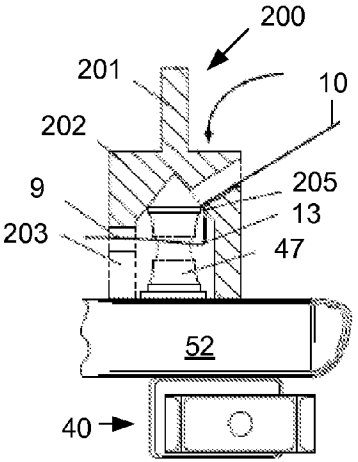
FIG. 4C is schematic diagram demonstrating a third step of the function of the preferred embodiment of the enclosure device.
Figure 4B:
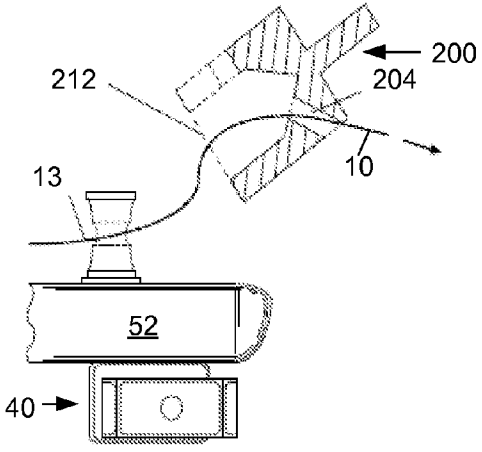
FIG. 4B is schematic diagram demonstrating a second step of the function of the preferred embodiment of the enclosure device.
Figure 4A:
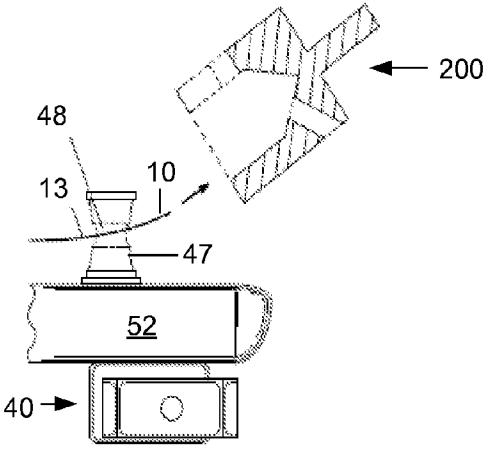
FIG. 4A is schematic diagram demonstrating a first step of the function of the preferred embodiment of the enclosure device.

In FIG. 4A, the tail end 10 of the string 13 is threaded through the borehole 48 of the tuning post 47, as shown by block 2010. In FIG. 4B, the tail end 10 of the string 13 is threaded in through the central bore opening 212 and out through the rear exit 204, as shown by block 2020. In FIG. 4C, the main body 202 is placed over the tuning post 47, substantially covering the tuning post 47, as shown by block 2030. A forward end of the string 9 is drawn through front opening 203, for example up the slot of the opening 203 and into the 'T' crossbar portion, as described above. Downward pressure may be applied on the device 200 toward the headstock 52 by the user via the grip 201, causing the string 13 to pinch or crimp between the tuning post 47 and the ceiling 205 and/or inner wall 211 of the device 200.

Figure 4E:
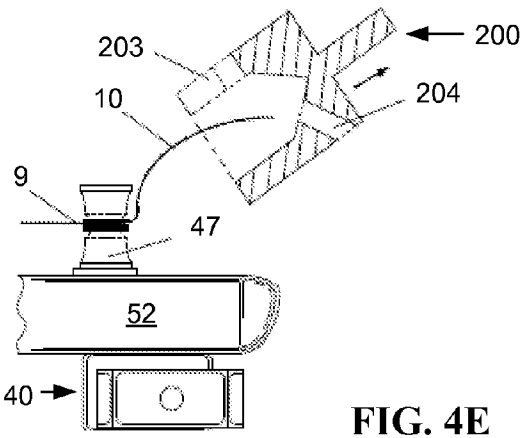
FIG. 4E is schematic diagram demonstrating a fifth step of the function of the preferred embodiment of the enclosure device.
Figure 4D:
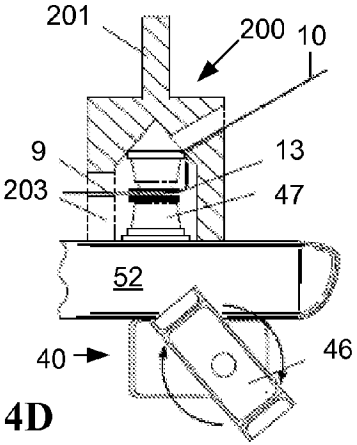
FIG. 4D is schematic diagram demonstrating a fourth step of the function of the preferred embodiment of the enclosure device.

The user rotates the tuning post 47, as shown by block 2040. The user generally rotates the tuning post by turning the tuning button 46. FIG. 4D shows the device in place against the headstock 52, for example, held by the user pressing the grip 201 with one hand and turning the tuning button 46 with the other, causing the tuning post 47 to rotate. The rotation of the tuning post 47 draws the forward end of the string 9 through the front opening 203 as the string 13 winds around the tuning post 47. FIG. 4E, illustrates the device 200 as it is lifted off the tuning post 47, where the tail end of the string 10 is threaded back through the rear exit 204, and the forward end of the string 9 slides out through the front opening 203.

The device 200 simplifies the mechanics for the user when winding a string: the device 200 is held by one hand while the tuning button 46 is rotated by the other hand. The enclosure device 200 is simple in structure. It preferably consists of a single piece that may be easily manufactured for low cost by mass-production processes, such as, but not limited to, plastic injection molding or metal die casting. As noted above, the general structure may be cylindrical with a closed or open top end and an open bottom end to receive the tuning post. There may be a grip, either ingrained on the outer face of the device or placed at the top. There is an opening on the front face of the device to receive the string, and another opening, for example, directly opposite on the back face, to also receive the string, such that the string may be threaded through the device and tuning post concurrently.

The front opening 203 is preferably in the shape of a "T" for several reasons. The top horizontal bar ("crossbar") of the "T" shape allows for left and right movement of the string 13 to align to its preferred position as it winds around the tuning post 47, thus reducing unnecessary tension in the string 13. The vertical stem of the "T" allows the string to enter and exit the front opening 203 through the base 242 of the device, such that the base of the "T" opening 203 meets the base 242 of the device. This allows the device 200 to be removed from the tuning post 47 after use without being impeded by the forward end 9 of the string 13.

The rear exit 204 on the back face of the device 200 may be placed level to the borehole 48 and front opening 203; however, this may result in both ends of the string 13 winding simultaneously, thus increasing winding time and effort. Therefore, the rear exit 204 is preferably positioned above or below the borehole 48 of the tuning post 47 such that the string 13 becomes crimped when the device 200 is placed onto the tuning post 47. In this way, the tail end 10 of the string is held in place, allowing only the front end 9 of the string 13 to wind around the tuning post 47.

Inside the device 200, the ceiling 205 may be cone-shaped or set with a predetermined number of protruding teeth so as to accommodate various tuning post sizes. A curved profile of the ceiling 205 may also be desirable for use with certain tuning machines. The base 242 is preferably held adjacent to headstock 52 and/or bearing 49 to provide a substantially enclosed area in which the string 13 can wind. The device 200 may also be magnetized, for example, if made from die cast metal, or a magnetized strip may be added to line the base 242 if the body 202 is not magnetic, for example, non-metal, so as to better attach to the base of the tuning post 47.

The device 200 may be made in a variety of sizes to correspond to the size of tuning posts 47 and the thickness of musical instrument strings 13. As tuning posts 47 and strings 13 vary slightly in size and thickness, the device 200 may too vary in size. As described above, a removable insert 2100 (FIG. 21) or inner sleeve may be provided for broader compatibility with variously sized tuning posts 47, both in terms of height and thickness of the tuning post 47.

In further embodiments, described below, the device and/or the tuning posts may be modified such that the user may attach and detach the device from the tuning posts as desired. For example, an exemplary system may include an enclosure device and paired with modified tuning posts. For instance, matching threading or locking mechanisms may allow the tuning post to receive the alternative device. In this way, the tuning post and device can be configured for a secure, removable fit during restringing. An additional piece, such as a rubber ring or spring, may be used for compression/expansion in the function of the locking mechanism. The alternative device may remain on the tuning posts, or removed for aesthetic purposes, once the string has been wound.

Figure 5:
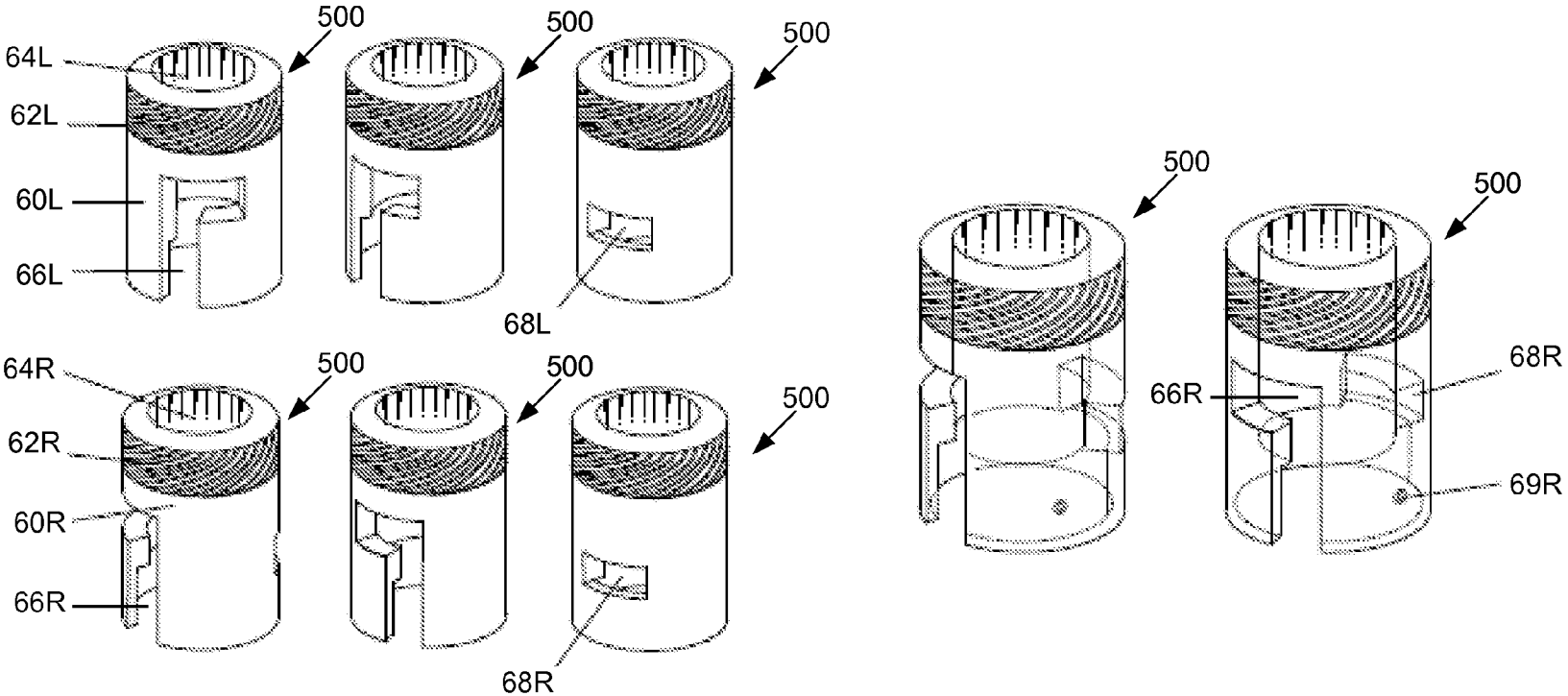
FIG. 5 is a schematic diagram showing several views of a second embodiment of an enclosure device that attaches to a tuning post.
Figure 9:
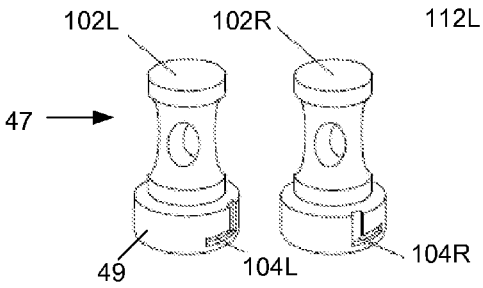
FIG. 9 is a schematic diagram of a first exemplary tuning machine as modified to attach to an enclosure device.

FIG. 5 shows several views a second embodiment for an enclosure device 500 that is attachable to tuning pegs by a fastening mechanism. The tuning pegs may be equipped with a mating fastening mechanism to engage with the fastening mechanism on the enclosure device 500. The second embodiment includes left and right symmetrical units for use with left and right positioned tuning pegs. The left unit 60L has an open top 64L, ingrained grip 62L, front opening 66L, and rear exit 68L. The right unit 60R has an open top 64R, ingrained grip 62R, front opening 66R, and rear exit 68R. The interior view of the right unit shows the rear exit 68R positioned below the front opening 66R. The notch 69R slides into a locking track 104R (FIG. 9) of a tuning machine (FIG. 9). Since the second embodiment 500 has an open top, the rear exit 68L, 64R may optionally be omitted, and the string tail end 10 (FIG. 1) may instead exit the device 500 through the open top 64L, 64R. In alternative embodiments, the enclosure device 500 may attach to the tuning machine 40 (FIG. 1) without modification to the tuning machine 40 (FIG. 1), for example, by a friction fit over the bearing 49. Such a friction fit could be further facilitated by a compressible insert 2100 (FIG. 21), as described above.

Figure 6:
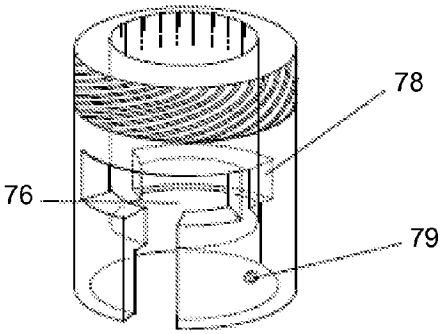
FIG. 6 is a schematic diagram of three views of a third embodiment of an enclosure device that attaches to a tuning post.
Figure 6:
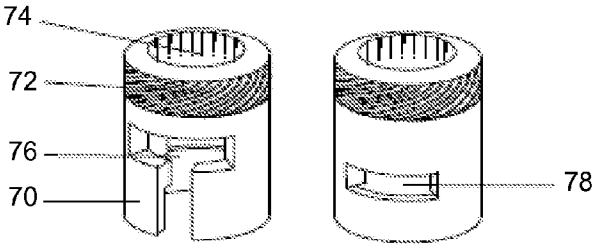

FIG. 6 shows a third embodiment for an enclosure device 70 that is attachable to modified tuning pegs by a locking mechanism. The third embodiment includes a single unit for use with both left or right positioned modified tuning pegs. The device 70 has an open top 74, ingrained grip 72, front opening 76, and rear exit 78. The interior view of the unit shows the rear exit 78 positioned below the front opening 76. The notch 79 slides into the locking track of the modified tuning peg.

Figure 7:
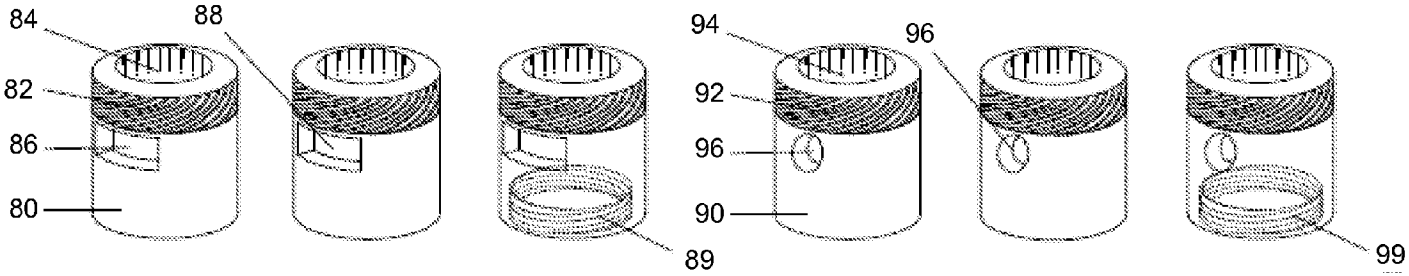
FIG. 7 is a schematic diagram showing fourth and fifth embodiments of enclosure devices that attach to a tuning post.
Figure 8:
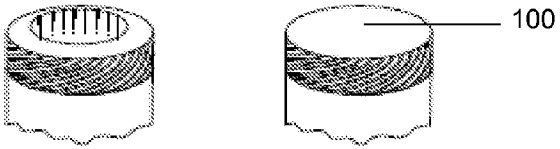
FIG. 8 is a schematic diagram of an alternative embodiment of the devices of FIGS. 5-7.

FIG. 7 shows a fourth embodiment 80 and a fifth embodiment 90 of enclosure devices that may each attach to modified tuning pegs by a threading mechanism. The unit 80 has an open top 84, ingrained grip 82, front opening 86, and rear exit 88. The interior view shows the threading 89. The unit 90 has an open top 94, ingrained grip 92, front opening 96, and rear exit 98. The interior view shows the threading 99, which matches the threading 154 of the modified tuning post 152 shown in FIG. 14. FIG. 8 shows an alternative design for an enclosure device having a closed top 100.

Figure 10:
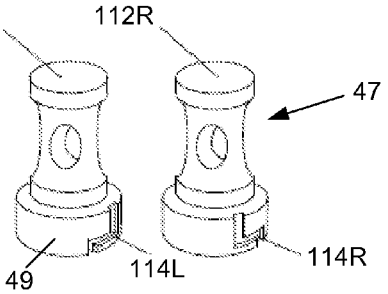
FIG. 10 is a schematic diagram of a second exemplary tuning machine as modified to attach to an enclosure device.
Figure 11:
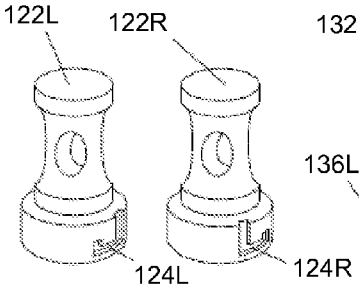
FIG. 11 is a schematic diagram of a third exemplary tuning machine as modified to attach to an enclosure device.

The tuning posts 47 may be modified in several ways to facilitate the second, third, fourth and fifth embodiments, as shown by FIG. 9 through FIG. 14. FIG. 9 shows an exemplary left unit 102L with a track 104L that is molded into the material of the bearing 49 such that the enclosure device 500 (FIG. 5) can lock onto it. There may be a symmetrical right unit 102R with a track 104R. FIG. 10 shows a left unit 112L with a different track 114L that extends downward to improve locking ability. There may be a symmetrical right unit 112R with track 114R. FIG. 11 shows yet another left unit 122L with a track 124L that extends upward to improve locking ability. There may be a symmetrical right unit 122R with track 124R.

Figure 12:
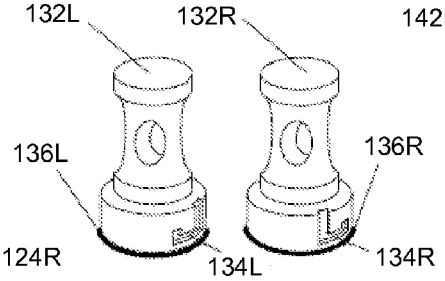
FIG. 12 is a schematic diagram of a fourth exemplary tuning machine as modified to attach to an enclosure device.
Figure 13:
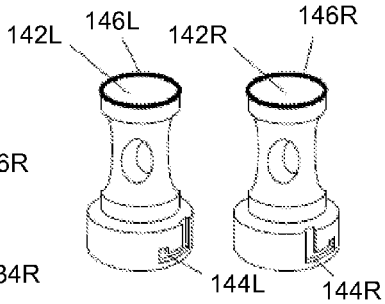
FIG. 13 is a schematic diagram of a fifth exemplary tuning machine as modified to attach to an enclosure device.
Figure 14:
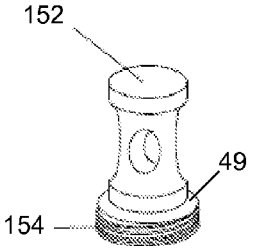
FIG. 14 is a schematic diagram of a sixth exemplary tuning machine as modified to attach to an enclosure device.

FIG. 12 shows a left unit 132L with left track 134L and an additional rubber ring 136L that may compress and expand against the enclosure device to lock it into the track. There may be a symmetrical right unit 132R with track 134R and ring 136R. FIG. 13 shows a left unit 142L with track 144L and a rubber ring 146L placed toward the top of the unit. There may be a symmetrical right unit 142R with track 144R and ring 146R. FIG. 14 shows a threaded tuning post 152 with threads 154 on an outer surface of the bearing 49, configured to mate with threads 89,99 (FIG. 7) on a corresponding enclosure.

Figure 15:
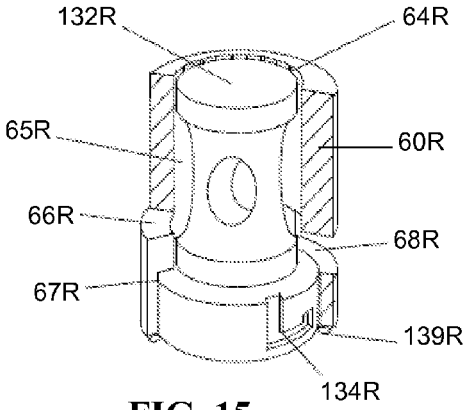
FIG. 15 is schematic diagram a partial view of an embodiment of the device engaged with a modified tuning post.
Figure 16A:
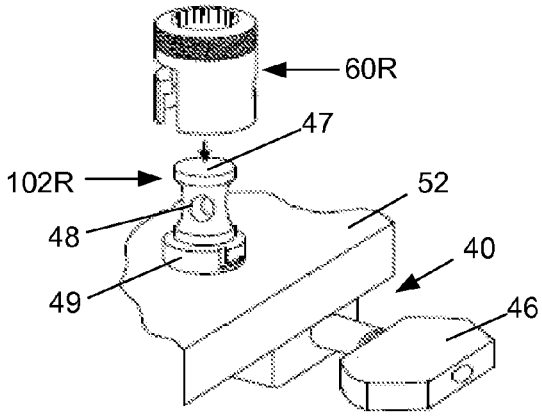
FIGS. 16A-16H are step-by-step schematic diagrams demonstrating the function of an alternative embodiment of the enclosure device that may attach to the modified tuning post.
Figure 16B:
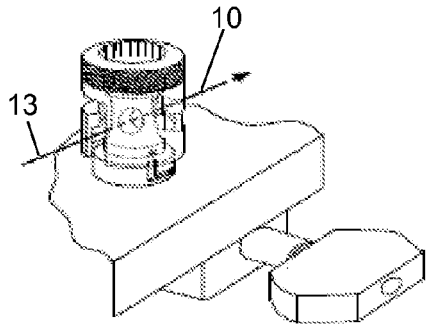
Figure 16C:
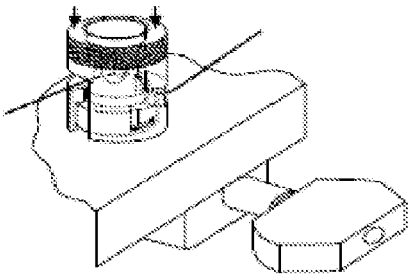
Figure 16D:
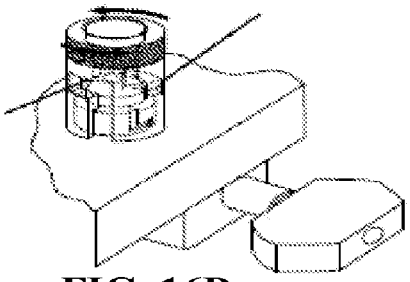
Figure 16E:
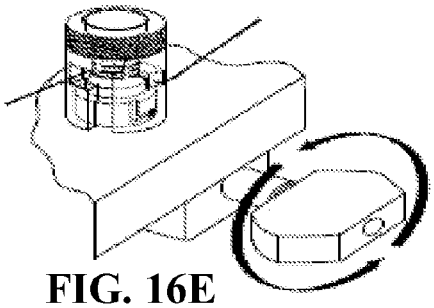
Figure 16F:
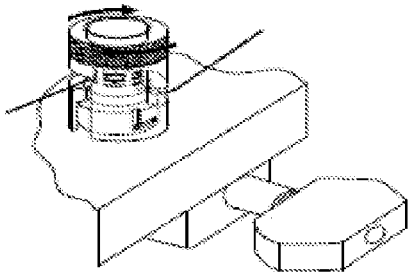
Figure 16G:
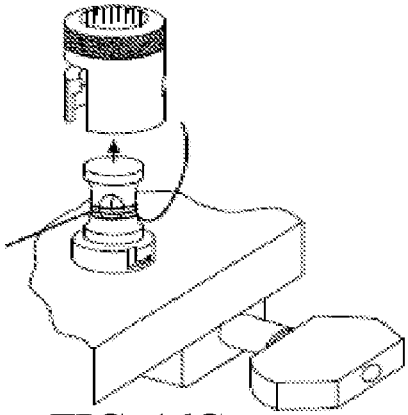
Figure 16H:
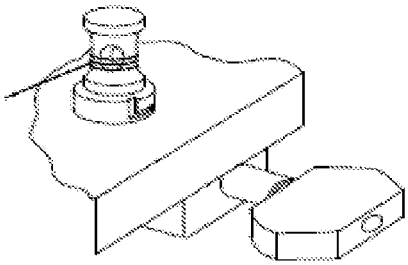

FIG. 15 shows a partial view of the right unit 60R placed over a modified tuning post 132R. The top of the tuning post 132R meets the top opening 64R. The inner wall 67R of the unit 60R is shaped such that it is flush with the tuning post 132R at the top and bottom, while leaving room in the main cavity 65R for the string to wind. When the rubber ring 136R is compressed, it provides upward force against the unit 60R such that the notch 69R (seen in FIG. 5) locks into the track 134R.

FIGS. 16A-16H are each step-by-step diagrams demonstrating the function of an alternative embodiment of an exemplary method for stringing a guitar using the enclosure device 60R that may attach to the modified tuning machine 102R. The method is similar to the method shown by flowchart of FIG. 20, and demonstrated by FIGS. 4A-4E, with the addition of the locking step shown in FIG. 16D, where the enclosure 60R is attached to the tuning machine 102R, and the unlocking step shown in FIG. 16F, where the enclosure 60R is de-attached from the tuning machine 102R.

Figure 17:
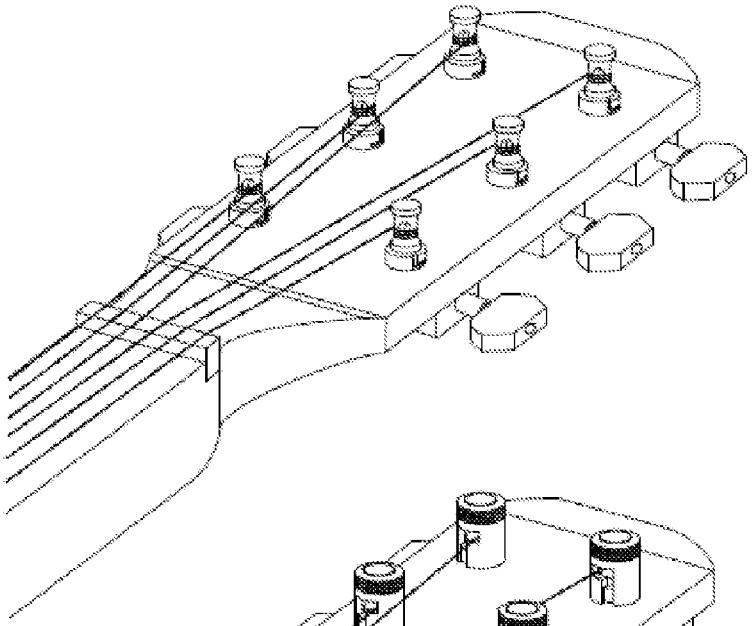
FIG. 17 is a schematic diagram of an upper neck and headstock of a guitar with tuning machines modified to attach to an enclosure device.
Figure 18:
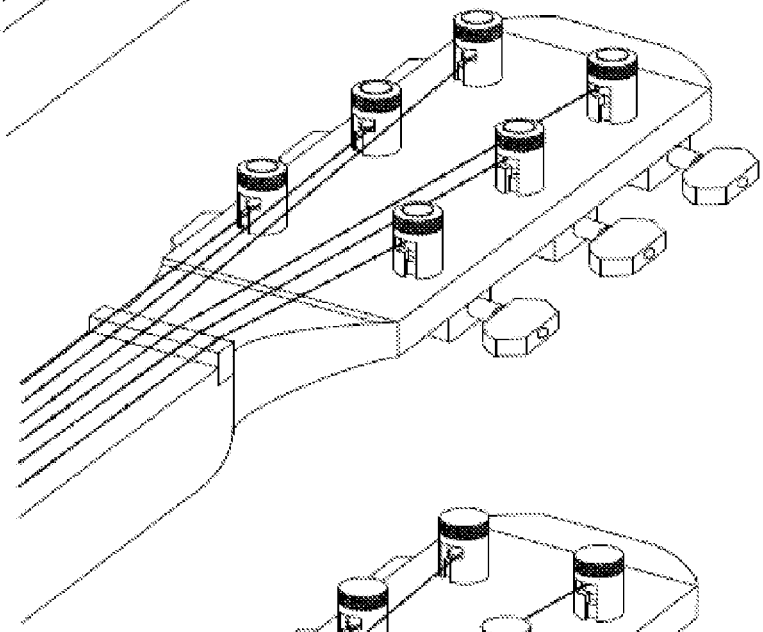
FIG. 18 is a schematic diagram of an upper neck and headstock of a guitar showing an open topped embodiment of the attachable enclosure device.
Figure 19:
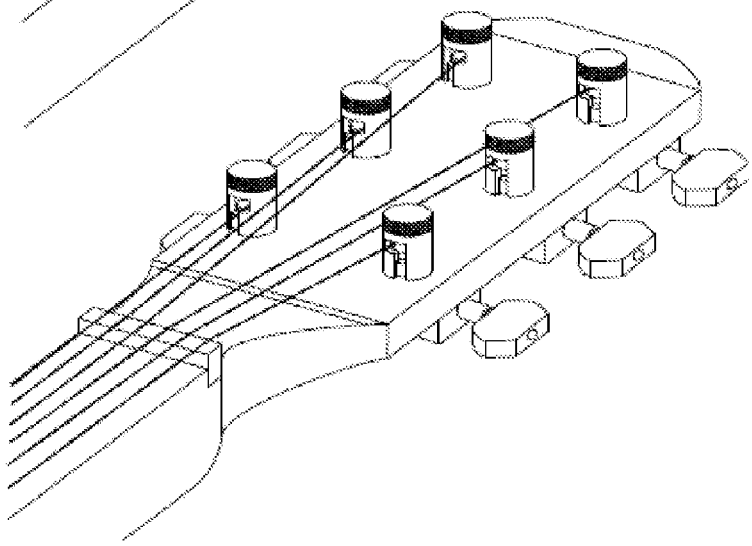
FIG. 19 is a schematic diagram of an upper neck and headstock of a guitar a closed top embodiment of the attachable enclosure device.

FIG. 17 shows an upper neck and headstock of a guitar with a tuning machine modification. FIG. 18 shows an upper neck and headstock of a guitar showing an open topped embodiment of the attachable enclosure device. FIG. 19 shows an upper neck and headstock of a guitar a closed top embodiment of the attachable enclosure device.

While the above enclosure devices have generally been described and depicted as being cylindrical in shape, other variations are possible. For example, the body may have a substantially rectangular exterior profile, to facilitate handling via fingers or pliers, or a hex shaped profile, to facilitate handling via fingers or a wrench. For such alternative embodiments, the shape of the body may serve in lieu of a separate grip.

While the above embodiments have generally been directed to application to a guitar, the embodiments are not limited to guitar, but are further applicable to other stringed instruments, for example, banjo, mandolin, ukulele, and other instruments.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A device for assisting winding a string around a tuning post of a tuning machine of a stringed instrument, comprising:

an enclosure comprising an exterior surface, a base, a cap disposed substantially opposite the base, and a central bore passing through a base aperture in the base;

a string ingress aperture disposed between the enclosure exterior surface and the central bore;

a slot through the enclosure exterior surface extending from the string ingress aperture to the base; and a string egress aperture disposed through the enclosure between the enclosure surface and the central bore, wherein the enclosure is configured to substantially enclose the tuning post within the central bore, and the slot is configured to enable the string to exit the enclosure via the slot so the enclosure is removable from the tuning machine while leaving the string wound around the tuning post.

2. The device of claim 1, wherein the string egress aperture is disposed on an opposite side of the enclosure from the ingress aperture.

3. The device of claim 1, further comprising a cap aperture through the cap.

4. The device of claim 3, wherein the egress aperture coincides with the cap aperture.

5. The device of claim 1, wherein the string ingress and the slot through the enclosure exterior surface combine to form a T shaped opening through the enclosure.

6. The device of claim 5, wherein the T shaped opening is configured to accommodate an instrument bridge pin.

7. The device of claim 6, wherein the string ingress opening is configured to accommodate a bridge pin head and the slot configured to accommodate a bridge pin stem.

8. The device of claim 1, further comprising a grip configured to facilitate holding the enclosure.

9. The device of claim 8, wherein the grip further comprises a structure protruding outward from the cap.

10. The device of claim 8, wherein the grip further comprises a textured exterior surface of the enclosure.

11. The device of claim 1, further comprising a cylindrical body.

12. The device of claim 1, further comprising a cylindrical central bore.

13. The device of claim 1, further comprising means for removably attaching the enclosure to the tuning machine.

14. A method for stringing a stringed musical instrument, comprising the steps of:

inserting a string end of an instrument string through a borehole in a tuning post;

inserting the string end through a string egress aperture in a tuning post enclosure;

covering the tuning post with the tuning post enclosure, wherein a string trailing portion of the instrument string is disposed through an ingress aperture in the tuning post enclosure;

rotating the tuning post; and removing the enclosure from the tuning post once the string has been wound.

15. The method of claim 14, further comprising the step of pinching the string between the tuning post and a ceiling and/or inner wall of the tuning post enclosure.

16. The method of claim 14, further comprising the step of removably attaching the tuning post enclosure to a tuning machine.

* * * * *